US012024397B2

(12) United States Patent
Bauman

(10) Patent No.: US 12,024,397 B2
(45) Date of Patent: Jul. 2, 2024

(54) DRILL-POWERED DRIP TAPE WINDER AND METHOD OF USE

(71) Applicant: John Bauman, Denver, CO (US)

(72) Inventor: John Bauman, Denver, CO (US)

( * ) Notice: Subject to any disclaimer, the term of this patent is extended or adjusted under 35 U.S.C. 154(b) by 0 days.

(21) Appl. No.: 18/112,051

(22) Filed: Feb. 21, 2023

(65) Prior Publication Data

US 2023/0331514 A1 Oct. 19, 2023

Related U.S. Application Data

(60) Provisional application No. 63/331,613, filed on Apr. 15, 2022.

(51) Int. Cl.

| | |
|---|---|
| ***B65H 75/30*** | (2006.01) |
| ***B65H 75/40*** | (2006.01) |
| ***B65H 75/42*** | (2006.01) |
| ***B65H 75/44*** | (2006.01) |

(52) U.S. Cl.

CPC ..... *B65H 75/305* (2013.01); *B65H 75/406* (2013.01); *B65H 75/42* (2013.01); *B65H 75/4468* (2013.01); *B65H 75/4481* (2013.01); *B65H 75/4486* (2013.01); *B65H 2402/41* (2013.01); *B65H 2701/333* (2013.01)

(58) Field of Classification Search

CPC ..... B65H 75/305; B65H 75/30; B65H 75/34; B65H 75/38; B65H 75/40; B65H 75/403; B65H 75/406; B65H 75/42; B65H 75/4457; B65H 75/4468; B65H 75/4481; B65H 75/4486; B65H 2402/41; B65H 2701/33; B65H 2701/332; B65H 2701/333; B65H 18/02; B65H 18/023; B65H 18/06; B65H 18/08; B65H 18/10; B67D 7/40; H02G 1/08; B60P 7/0823; B60P 7/0846

See application file for complete search history.

(56) References Cited

U.S. PATENT DOCUMENTS

| | | | | | |
|---|---|---|---|---|---|
| 2,738,143 | A | | 3/1956 | Hannay | |
| 2,772,056 | A | * | 11/1956 | Geisinger | B65H 75/4473 D8/358 |
| 3,516,618 | A | * | 6/1970 | Reinke | A61F 15/007 242/546 |
| 3,826,275 | A | | 7/1974 | Courtright | |
| 4,186,881 | A | | 2/1980 | Long | |
| 4,290,584 | A | * | 9/1981 | Eckels | B66F 11/04 242/390.8 |
| 4,513,772 | A | | 4/1985 | Fisher | |
| 4,716,613 | A | * | 1/1988 | Irwin | E03F 9/005 15/104.33 |

(Continued)

FOREIGN PATENT DOCUMENTS

| | | | | |
|---|---|---|---|---|
| KR | 200495370 Y1 | * | 5/2022 | B65H 75/4486 |
| KR | 20220001508 U | * | 6/2022 | B65H 75/4486 |
| KR | 200495869 Y1 | * | 9/2022 | B65H 75/403 |

*Primary Examiner* — Michael R Mansen
*Assistant Examiner* — Raveen J Dias
(74) *Attorney, Agent, or Firm* — Leyendecker & Lemire, LLC

(57) ABSTRACT

A drip tape winder for easily and cost-effectively rolling lengths of drip tape in the field is described. The winder comprises a frame and a mandrel rotatably received in the frame and utilizes a battery powered drill to provide the power necessary to turn the mandrel and neatly wind lengths of drip tape thereon.

18 Claims, 6 Drawing Sheets

(56) References Cited

U.S. PATENT DOCUMENTS 4,777,976 A 10/1988 Johnston
4,830,283 A 5/1989 Johnson
4,832,074 A 5/1989 Li
4,951,890 A * 8/1990 Sossamon ..... A01K 89/003 242/390.8
4,993,449 A 2/1991 Stutzman
5,056,732 A * 10/1991 Nicholson, Jr. ..... B65H 54/54 242/395
5,277,350 A * 1/1994 Thornbury, Jr. ..... A63H 27/002 242/390.8
6,361,021 B1 3/2002 Brennan
6,398,147 B1 * 6/2002 Fredrickson ..... B65H 75/305 242/390.8
6,467,755 B2 * 10/2002 Reilly ..... B60P 7/0846 254/223
6,513,791 B1 * 2/2003 Yates ..... B65H 75/305 242/395
6,648,262 B1 * 11/2003 Huffman ..... B65H 75/305 242/390.8
6,659,429 B2 * 12/2003 Shoji ..... F16H 1/32 254/342
6,672,329 B1 1/2004 Brooks
6,705,597 B1 * 3/2004 Reilly ..... B60P 7/0846 254/223
7,059,588 B2 * 6/2006 Goulet ..... B65H 54/585 254/323
7,086,622 B1 * 8/2006 Whaley ..... A01K 89/017 242/250
7,278,808 B1 * 10/2007 Sisk, Sr. ..... B60P 7/0853 279/144
7,410,336 B2 * 8/2008 Parks ..... B60P 7/0846 279/144
7,909,280 B1 * 3/2011 Herrick ..... A01K 89/017 242/250
8,230,567 B2 * 7/2012 Denning ..... B65H 75/305 81/119
8,403,250 B1 * 3/2013 Callahan ..... B65H 75/4478 242/533.8
8,827,198 B1 * 9/2014 Steadman, Sr. ..... B65H 75/305 242/613.2
9,156,652 B1 * 10/2015 Warboys ..... B65H 79/00
9,707,136 B2 * 7/2017 Broten ..... B65H 18/026
9,789,984 B2 * 10/2017 Sikora ..... B65B 13/22
9,918,457 B2 * 3/2018 Masten ..... B65H 54/44
10,088,016 B2 * 10/2018 Bujold ..... B60P 7/0853
10,144,612 B2 * 12/2018 Stelmack ..... B65H 54/106
10,280,037 B2 * 5/2019 Henderson ..... B60P 7/0846
10,294,067 B1 * 5/2019 DeBellis ..... B65H 75/305
10,486,934 B2 * 11/2019 Oehrlein ..... B65H 54/44
10,526,812 B1 * 1/2020 Vogeler ..... B65H 75/425
10,618,770 B1 * 4/2020 Vogeler ..... B65H 75/4402
10,640,326 B2 * 5/2020 Henderson ..... B60P 7/0846
10,793,303 B2 * 10/2020 Sikora ..... B65B 13/327
10,927,924 B2 * 2/2021 Bujold ..... F16H 1/16
11,001,472 B2 * 5/2021 Henderson ..... B65H 54/585
11,129,374 B2 * 9/2021 Jaramillo ..... A01K 89/01931
11,139,643 B1 * 10/2021 DeBellis ..... B65H 75/406
11,191,259 B1 * 12/2021 Nevius ..... A41D 19/0041
11,271,376 B1 * 3/2022 Beck ..... B66D 1/7489
11,440,765 B1 * 9/2022 DeBellis ..... B65H 75/406
11,472,660 B1 * 10/2022 DeBellis ..... B65H 75/406
11,472,661 B2 * 10/2022 Gonsalves ..... B65H 75/4486
11,511,893 B2 * 11/2022 Sikora ..... B65B 13/027
11,633,638 B2 * 4/2023 Corrigan ..... B65H 75/4494 248/80
11,641,094 B1 * 5/2023 Beck ..... B66D 1/7489 254/134.3 FT
11,891,199 B2 * 2/2024 Sikora ..... B65B 13/22
11,894,664 B2 * 2/2024 Alimi ..... H02G 1/083
2001/0045550 A1 * 11/2001 Reilly ..... B66D 3/18 81/180.1
2003/0108391 A1 * 6/2003 Essay ..... B65H 49/32 405/177
2004/0007701 A1 * 1/2004 Goulet ..... B60P 7/0846 254/213
2004/0065764 A1 * 4/2004 Rosaen ..... B65H 75/406 242/395
2007/0212186 A1 * 9/2007 Parks ..... B61D 45/00 410/156
2008/0023580 A1 * 1/2008 Steeber ..... B65H 54/58 242/390.8
2008/0066808 A1 * 3/2008 Stein ..... B65H 75/4463 137/355.12
2009/0236459 A1 * 9/2009 McMann ..... B65H 75/305 242/390.9
2011/0079967 A1 * 4/2011 Presley ..... B66D 1/12 279/145
2011/0101144 A1 * 5/2011 Denning ..... B65H 54/585 81/119
2014/0007781 A1 * 1/2014 Sikora ..... B65B 13/027 100/29
2014/0110520 A1 * 4/2014 Hampson ..... B60P 7/0846 242/395
2014/0138470 A1 * 5/2014 Bunting ..... B60P 7/0846 242/390
2014/0306053 A1 * 10/2014 Karius ..... B65H 18/10 242/532.6
2016/0058633 A1 * 3/2016 Broten ..... B65H 54/585 242/546
2016/0088822 A1 * 3/2016 Masten ..... A01K 89/012 403/44
2016/0214829 A1 * 7/2016 Stelmack ..... B65H 54/106
2016/0339830 A1 * 11/2016 McLemore ..... B65H 54/585
2017/0022026 A1 1/2017 Chapa
2017/0058998 A1 * 3/2017 Bujold ..... B66D 1/14
2018/0099836 A1 * 4/2018 Oehrlein ..... B65H 54/106
2018/0179018 A1 * 6/2018 Henderson ..... B60P 7/083
2018/0328452 A1 * 11/2018 Bujold ..... F16H 1/16
2019/0256319 A1 * 8/2019 Henderson ..... B65H 54/585
2019/0292009 A1 9/2019 Gonsalves
2020/0262675 A1 * 8/2020 Henderson ..... B65H 75/305
2021/0229949 A1 * 7/2021 Henderson ..... B65H 75/305
2021/0307308 A1 * 10/2021 Knight ..... B65H 49/34
2022/0267116 A1 * 8/2022 Peck ..... H02G 1/083
2022/0331630 A1 * 10/2022 Corrigan ..... B65H 54/585
2022/0356042 A1 * 11/2022 Foley ..... B65H 75/403

* cited by examiner

DRILL-POWERED DRIP TAPE WINDER AND METHOD OF USE

BACKGROUND

Agricultural drip tape typically comprises relatively thin (6-15 mils) plastic tubing that has spaced slits cut into it along its length that when supplied and filled with pressurized water permits the water to drip or slowly flow from the slits onto the surrounding ground to irrigate adjacent crops. One common variation is about ⅝" in diameter when expanded but lays flat when empty and not in use.

Drip tape is used by both commercial and hobby farmers. Commercial users can have dedicated machines that can roll up long lengths of tape at the end of a growing season with relative ease. These devices, which typically include gas powered motors are relatively expensive, large, and heavy making them impractical for use by a hobby farmer or small commercial farm. Hobby farms typically pull up tape by hand and may find winding and storage of used tape both time consuming and impractical opting to buy new tape each year rather than deal with untangling previously used tape pulled from the garden the season before.

DETAILED DESCRIPTION OF THE PRESENT INVENTION

Figure 1:
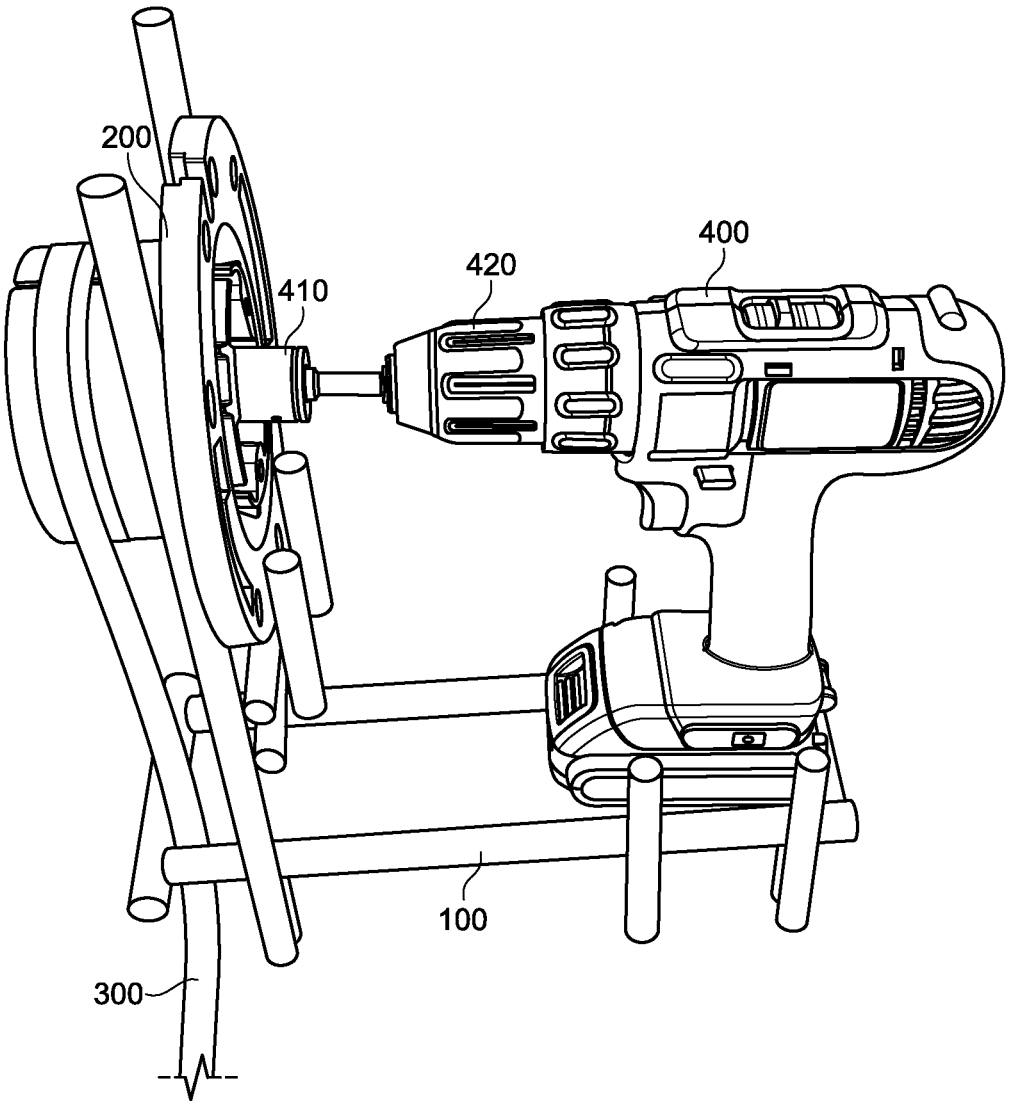
FIG. 1 is a perspective view from a first perspective of the drip tape winder in combination with a battery-powered handheld drill and a length of drip tape according to an embodiment of the present invention.

Embodiments of the present invention comprise a relatively-lightweight portable device for easily and cost-effectively rolling lengths of drip tape in the field. Embodiments, which each comprise a framework and a rotating mandrel, utilize a battery powered drill to provide the power necessary to operate the device and neatly wind lengths of drip tape onto the mandrel while in some variations also squeezing excess water retainer therein out of the tape. The resulting rolls of tape can be slid off of the mandrel and stored for use next season.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive, rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

As used herein, a "Handheld Drill refers to an electrically portable drill designed to be held in a user's hand during use. Often handheld drills are battery powered with a removable battery pack being located at a base of the drill below the handle thereof.

As used herein the term "Chuck" refers to any clamp or mechanism on the rotating portion of a portable drill to which one or more of drill bits, shanks, sockets, and driver bits can be secured.

As used herein "Drip Tape" refers to a generally flexible elongated tube, typically plastic, having holes or slits distributed along its length that when empty lies flat comprising front and back sides connected at longitudinally extending folded edges. Typical drip tapes used agriculture are about ⅝" wide when flat and have wall thicknesses of about 5-15 mm although other sizes are known.

As used herein any reference to axis, axis of rotation, axial length and related terms refer to the direction defined by the drip tape mandrel's axis of rotation. Typically, this axis also corresponds to the longitudinal dimension of the drip tape frame.

Embodiments of a Drip Tape Winder Assembly

Figure 2:
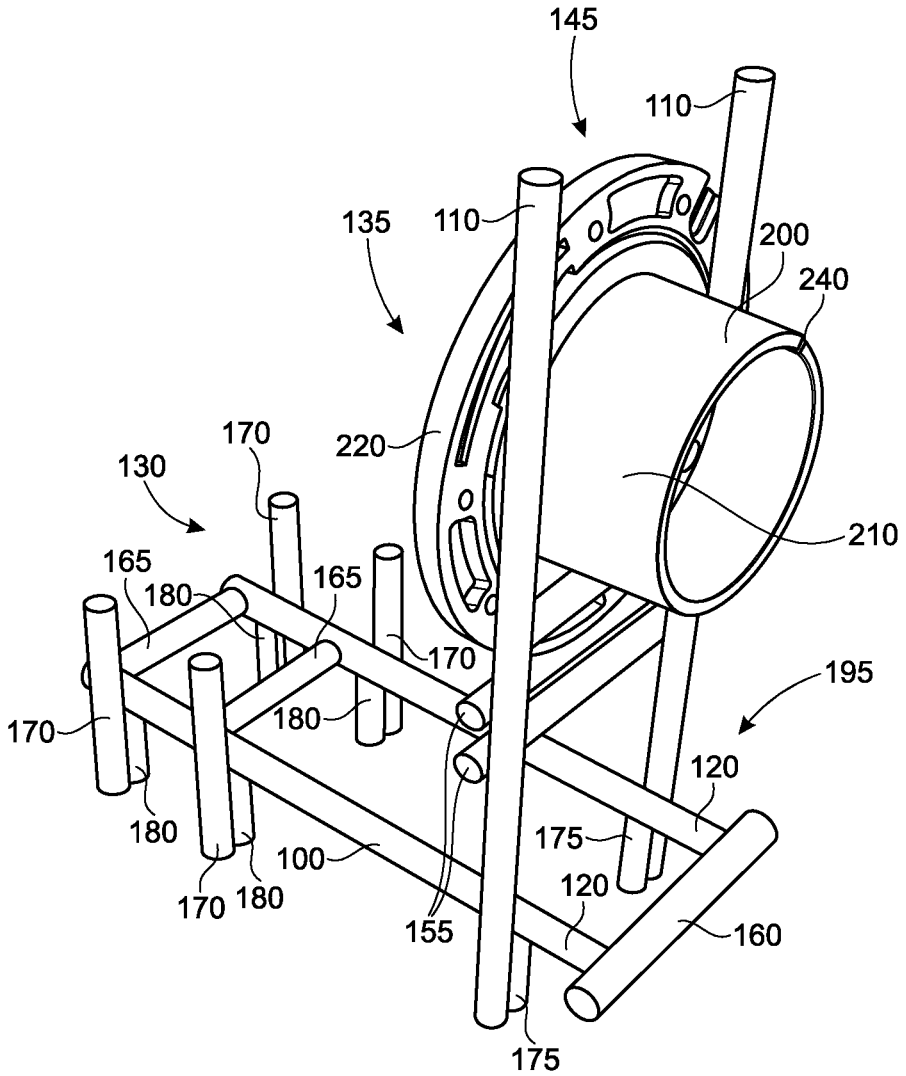
FIG. 2 is a perspective view from a second perspective of the drip tape winder according to an embodiment of the present invention.
Figure 3:
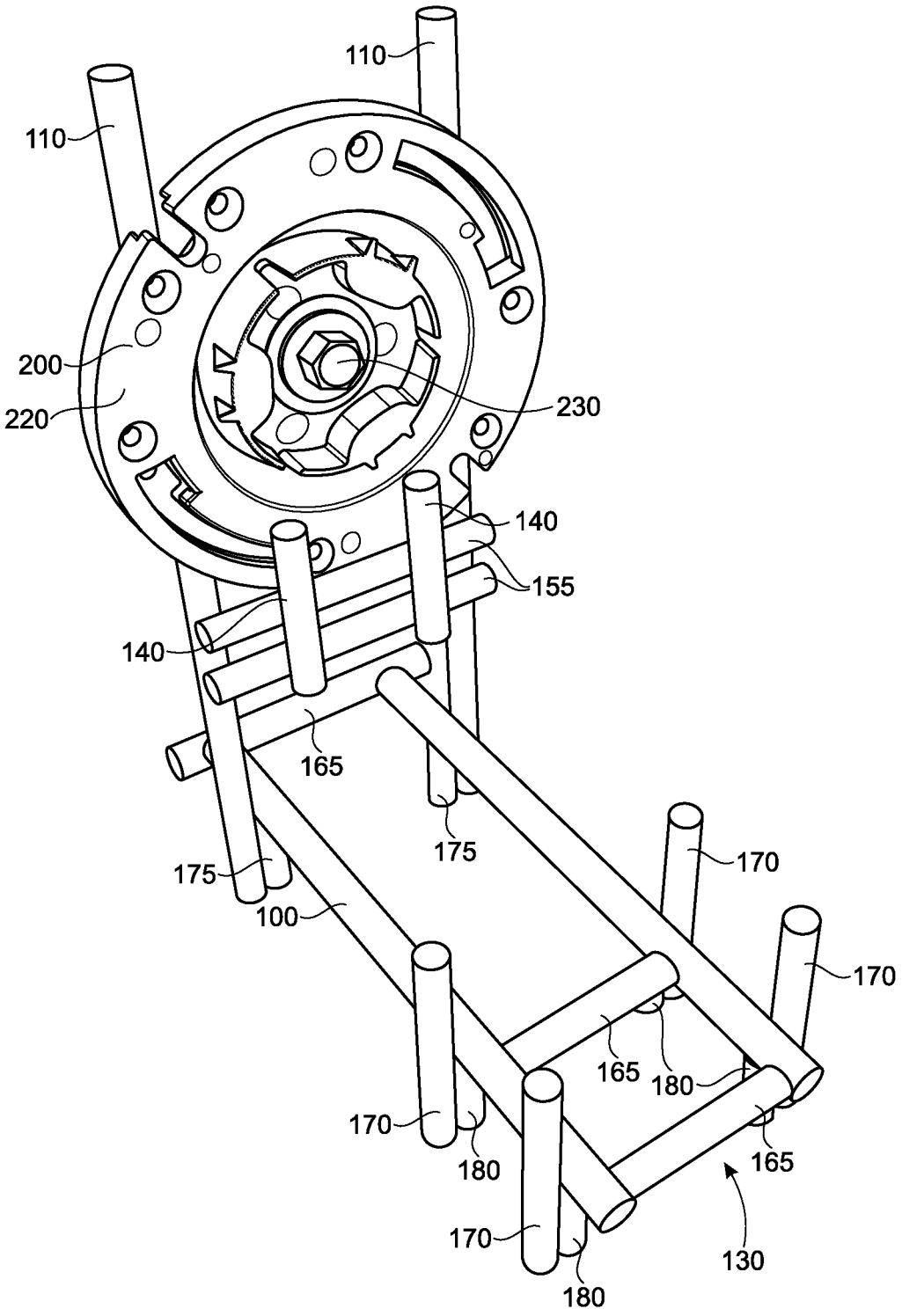
FIG. 3 is a perspective view from a third perspective of the drip tape winder according to an embodiment of the present invention.

FIGS. 1-3 illustrate a drip tape winding assembly from several different perspectives. FIG. 1 also shows a drill 400 received in the drill cradle 130 of the frame 100 with a socket 410 attached to the mandrel 200. The drip tape winder assembly is comprised of two primary pieces: the frame and the mandrel.

Figure 4:
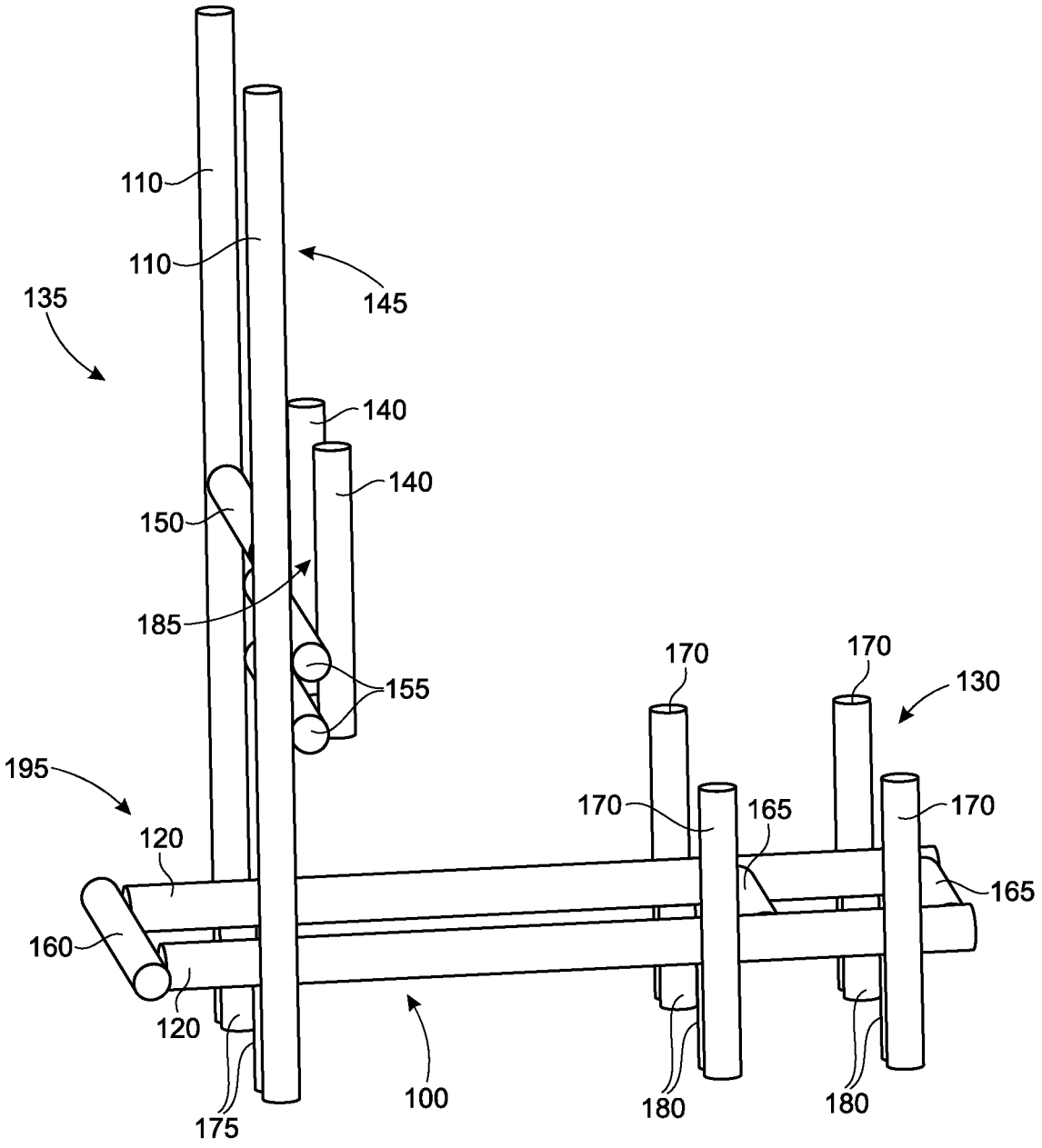
FIG. 4 is a perspective side view of the frame of the drip tape winder according to an embodiment of the present invention.

The frame 100 is illustrated by itself in FIG. 4. It is comprised wholly of various pieces of metal rod that have been joined together typically by welding, although other means of joining the rod pieces can be utilized. In at least one variation, the rod comprises ⅜" to ½" steel rod, although aluminum rod can be used as well. Further, reinforced or unreinforced plastic rods can be used as well wherein the rod sections are joined by plastic welding and/or adhesive bonding. As can be appreciated other variations of the frame are contemplated wherein the configuration of the frame differs both visually and in the nature of its construction from the embodiment described herein, but has similar functionality.

The illustrated embodiment of the frame 100 comprises a pair of parallel spaced longitudinal base rods 120 that extend substantially the entire length of the frame from a distal end to a proximal end. A laterally-extending horizontal distal end rod 160 is attached to the distal end of each longitudinal rod. Further, a pair of cradle support rods 165 extend between the longitudinal base rods proximate their proximal ends. Together, the longitudinal base rods, the cradle support rods and the distal end rod form the frame's base. The base is elevated off an underlying surface by way of a pair of parallel spaced vertical distal foot rods 175 and a set of four proximal foot rods 180. The foots rods lift the base about 1-2" off an underlying surface.

Four vertically-extending cradle rods 170 that rise above the base are provided near the distal end of the frame forming in conjunction with this portion of the base a drill cradle 130. The drill cradle is configured to receive the bottom end of a battery-operated portable drill 400 therein with the bottom of the battery resting on the longitudinal base rods 120 and the associated cradle support rods 165. The cradle rods stabilize the drill and hold the drill in place during operation preventing it from rotating to the left or right when activated.

A pair of vertical bearing rods 110 extend upwardly above the base spaced about a couple of inches behind the distal end rod 160 and are generally parallel to the vertical distal foot rods 175. The parallel vertical bearing rods are spaced apart a distance similar or slightly greater than the diameter of a hub portion 210 of the mandrel 200. At an intermediate position along the lengths of the vertical bearing rods a horizontal bearing rod 150 is provided spanning the spacing therebetween. During use, the mandrel hub rests upon the horizontal bearing rod and is constrained on its right and left sides by the vertical bearing rods forming a hub slot portion 145 of the mandrel cradle 135.

One or more horizontal spacer rods 155 are secured to the proximal facing side of the vertical bearing rods 110 at a location above the base but below the horizontal bearing rod 150. The diameter of these rods is typically greater than the thickness of the mandrel flange 220. One or more stopper rods 140 are secured to the proximal facing side of the spacer rods to form a flange slot portion 185 of the mandrel cradle 135 into which the mandrel flange is received. The stopper rods are relatively short compared to the vertical bearing rods 110 covering only a bottom portion of the mandrel flange below the longitudinal axis of the mandrel 200.

In operation, as will be discussed further below, the vertical bearing rods 110 inhibit side to side motion of the mandrel 200 in the frame 100; whereas the horizontal bearing rod 150 sets the vertical position of the mandrel. The flange slot portion 185 formed by the spacing between the stopper rod(s) 155 and vertical bearing rods acts to restrain the axial movement of the mandrel during use.

As can be seen in FIG. 4 and other figures, the longitudinal base rods 120 extend longitudinally distally of the vertical bearing rods terminating at distal ends 1-2 inches or so past the location where the vertical bearing rods are attached to the longitudinal base rods. In combination with the horizontal distal end rod 160, a tape guide portion 195 is formed. As best shown in FIG. 1, a drip tape is typically threaded under a longitudinal base rod in the tape guide portion to facilitate winding onto the mandrel. Often a user will hold and tension the drip tape 300 in such a manner as to cause the tape to be pressed against the longitudinal base rod during winding thereby squeezing water remaining in the tape therefrom prior to being wound onto the mandrel 200.

Figure 5:
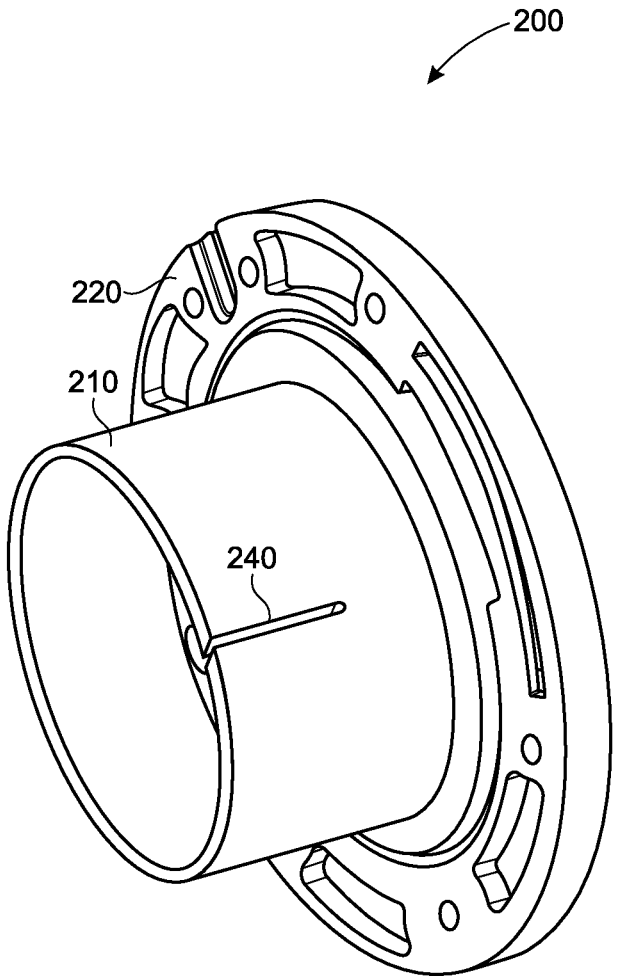
FIG. 5 is a perspective view of the mandrel of the drip tape winder according to an embodiment of the present invention.

The mandrel 200 is illustrated by itself in FIG. 5 and rotatably received in the frame 100 in FIGS. 1-3. The mandrel typically comprises a hub portion 210, a mandrel flange 220, and a drill attachment head 230. The hub portion is generally cylindrical having a diameter similar to the spacing between the vertical bearing rods 110 of the hub slot portion 145 in which it is received. The proximal end terminates at the flange portion. The hub portion is typically tubular and includes a tape slit 240 that extends inwardly from the distal end. In use, an end of the drip tape is fed into the slit to help hold the tape on the hub as it is wound.

The mandrel flange 220 has a diameter significantly greater than the diameter of the hub portion 210 and a flange thickness. The thickness of the flange corresponds with the spacing of the flange slot portion 185 between the vertical bearing rods 110 and the one or more stopper rods 140 so that it can be received therebetween.

On the proximal side of the mandrel flange 220 along the mandrel's axis of rotation, a drill attachment head 230 is provided. As shown, the attachment head is hexagonal in shape and configured to receive a suitably sized standard socket thereover, although in variations the head can comprise any suitable shape corresponding with a mating attachment associated with a drill 400. For instance, in variations the head can be square or in other variations the head can be recessed, such as to receive a hex key secured to the drill therein.

As illustrated, the mandrel 200 is comprised primarily of PVC and is constructed from commonly available PVC pipe fittings. The attachment head 230 comprises a bolt that is secured to the center of the flange. As can be appreciated, the mandrel can be fabricated from other suitable materials of various diameters and configurations.

FIGS. 2&3 show the mandrel 200 rotatably received in the frame 100; whereas, FIG. 1 also shows a battery-operated portable drill 400 received in the frame and attached to the mandrel. In operation, the mandrel rotates relative to the frame when turned by the drill. The hub rests on and rotates against the horizontal bearing rod 150 while being further constrained from rolling to the left or right by the corresponding vertical bearing rods 110. The bottom portion of the flange below the attachment head 230 is received in the flange slot portion 185, which prevents the mandrel from moving axially during operation. In general, the tape winder operates at relatively low speeds, such as 100 rpm or so, for relatively short periods of time, typically less than one to two minutes, and as such, the friction between the frame and the mandrel does not cause excessive heat or undue wear.

Operation of the Embodiment of the Drip Tape Winder

Figure 6:
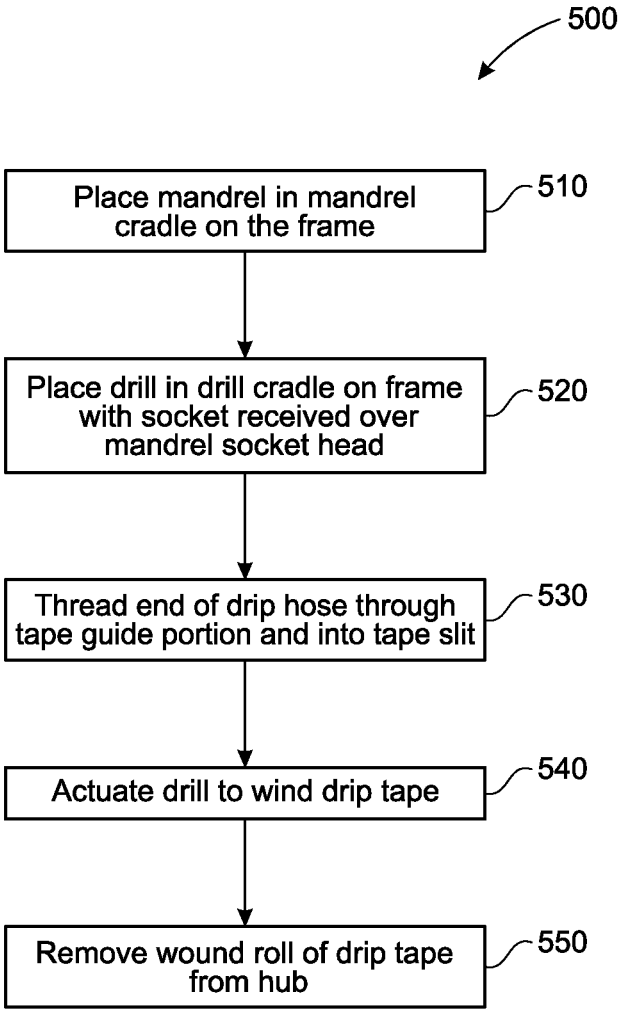
FIG. 6 is a flow chart pertaining to the operation of an embodiment of the drip tape winder according to an embodiment of the present invention.

FIG. 6 comprises a block diagram 500 pertaining to the operation of the drip tape winder. Of significant note, the drip tape winder is typically relatively small and portable such that it can be easily carried into a field or plot to wind lengths of drip tape. Typically, the frame is no longer than about 14" and no wider than about 5" although larger variations are contemplated.

At the end of a growing season usually after the associated plants have been harvested, the gardener or farmer carries the winder along with a portable drill to the location in a field where lengths of drip tape have previously been laid. The frame is placed on a relatively flat piece of ground or other underlying surface and prepared for use.

As indicated in block 510, the mandrel is slid into place in the frame. Specifically, the hub portion 210 is slid between the vertical bearing posts 110 into the hub slot portion 145 and the bottom of the mandrel flange 220 is slid into the flange slot portion 185 until the hub portion bottoms out on the horizontal bearing rod 150

Next as indicated in block 520, a bottom end of a portable drill, typically the battery, is placed in the drill cradle 130 and a suitable socket 410 is secured to the chuck 420 of the drill is connected to the drill attachment head 230. The drip tape winder is then ready for use.

As indicated by block 530, the end of a suitable length of drip tape 300 is passed under at least one of the two longitudinal base rods 120 of the tape guide portion 195, pulled upwardly and secured in the hub's tape slit 240.

The drill is then actuated to rotate the mandrel 200 and pull the tape 300 around the hub portion 210 forming a roll as indicated in block 540. Often the user will hold the drip tape apply a small amount of tension as it slides through the user's hand to draw the tape against a longitudinal base rod 120 and force excess water from the tape prior to its being received on the mandrel.

Finally, as shown in block 550, the wound roll of drip tape 300 is slid off the end of the mandrel 200 and stored for future use usually during the next growing season. As can be appreciated, the entire process can be repeated many times until all or substantially all the tape in a field has removed from the field and wound.

Alternative Variation and Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A handheld drill-powered portable drip tape winder, the winder comprising:

a frame configured for receipt on a generally horizontal surface, the frame including a drill cradle configured to receive and hold a handheld drill, and a mandrel cradle; and a drip tape mandrel being rotatably received in the mandrel cradle, the drip tape mandrel having a generally cylindrical hub and a drill attachment head centered on an axis of rotation, the hub configured to permit the winding of a drip tape thereon, and the drill attachment head configured to facilitate direct or indirect attachment to a chuck of the handheld drill;

wherein (a) when the handheld drill is received in the frame and coupled to the drill attachment head and activated, the drip tape mandrel rotates relative to the frame, (b) the hub has a first diameter and the drip tape mandrel further includes a circumferential flange at a hub proximal end, the circumferential flange having a second diameter, the second diameter being substantially greater than the first diameter, and (c) the mandrel cradle comprises a pair of substantially vertical members spaced apart a first distance, and a substantially horizontal member spanning between the vertical members, wherein (i) the first distance is at least slightly greater than the first diameter and less than the second diameter and (ii) the hub rests on the horizontal member with the hub proximal end between the vertical members.

2. The portable drip tape winder of claim 1, wherein the frame is no more than 15" long, 15" high, and 5" wide.

3. The portable drip tape winder of claim 1, wherein the frame is substantially comprised of metal rod.

4. The portable drip tape winder of claim 1, wherein the drill cradle is configured to removably receive a battery pack at a base of the handheld drill therein and prevent the handheld drill from rotating relative to the frame when coupled to the drill attachment head and activated.

5. The portable drip tape winder of claim 4, wherein the drill cradle comprises four or more generally vertically extending posts.

6. The portable drip tape winder of claim 1, wherein (a) the mandrel cradle further includes at least one positioning member, (b) the at least one positioning member is axially spaced from the vertical members a second distance, (c) the second distance being at least slightly greater than a circumferential flange thickness, and (d) at least a portion of the circumferential flange is located between the at least one positioning member and the vertical members.

7. The portable drip tape winder of claim 6, wherein the vertical members and the positioning member comprise metal rods.

8. The portable drip tape winder of claim 1, wherein a distal end of the hub includes an axially extending slit configured to receive an end of the drip tape therein.

9. The portable drip tape winder of claim 1, wherein the drill attachment head comprises a hexagonal socket head.

10. In combination, the handheld drill-powered portable drip tape winder of claim 1 and the handheld drill, wherein the handheld drill is received in the drill cradle and operatively coupled to the drill attachment head.

11. The combination of claim 10, wherein the handheld drill is battery powered.

12. The combination of claim 10, wherein the chuck is coupled to the drill attachment head by way of a socket and associated shank secured in the chuck.

13. The combination of claim 12, further including a drip tape, wherein an end of the drip tape is received in a tape slit located at a distal end of the hub.

14. In combination, the handheld drill-powered portable drip tape winder of claim 6 and the handheld drill, wherein the handheld drill is received in the drill cradle and operatively coupled to the drill attachment head.

15. A method of winding drip tape using the handheld drill-powered portable drip tape winder of claim 1, the method comprising:

placing the handheld drill in the drill cradle and coupling the chuck with the drill attachment head;

securing an end of a length of drip tape to the hub;

actuating the handheld drill to wind the length of the drip tape around the hub; and removing roll of wound drip tape from the hub.

16. The method of winding drip tape of claim 15 further comprising placing the drip tape mandrel in the mandrel cradle.

17. A method of winding drip tape using the handheld drill-powered portable drip tape winder of claim 6, the method comprising:

placing the drip tape mandrel in the mandrel cradle with the hub received between the substantially vertical members and resting on the horizontal member, and at least part of the circumferential flange received between the substantially vertical members and the at least one positioning member;

placing the handheld drill in the drill cradle and coupling the chuck with the drill attachment head;

securing an end of a length of drip tape to the hub;

actuating the handheld drill to wind the length of the drip tape around the hub; and removing roll of wound drip tape from the hub.

18. A handheld drill-powered portable drip tape winder, the winder comprising:

a drip tape mandrel, the drip tape mandrel having (i) a generally cylindrical hub of a first diameter, proximal and distal ends, and a drip tape receiving slit extending inwardly from the distal end, (ii) a circumferential flange at the proximal end having a second diameter that is greater than the first diameter, and (iii) a drill attachment head centered on an axis of rotation, wherein the hub is configured to permit winding of drip tape thereon, and the drill attachment head is configured to facilitate direct or indirect attachment to a chuck of a handheld drill; and a frame comprised substantially of metal rod, the frame for receipt on a generally horizontal surface, the frame including (a) a drill cradle for receiving and holding a battery pack attached to the handheld drill, and (b) a mandrel cradle, wherein the mandrel cradle includes (1) a pair of substantially vertical members spaced apart a first distance, and a substantially horizontal member spanning between the vertical members, the first distance being at least slightly greater than the first diameter and less than the second diameter, and (2) at least one positioning member being spaced axially from the pair of vertical members a second distance, the second distance being at least slightly greater than a circumferential flange thickness;

wherein the drip tape mandrel is rotatably received in the mandrel cradle with the hub resting on the horizontal member and with the proximal end of the hub between the pair of vertical members, and the circumferential flange being at least partially received between the pair of vertical members and the at least one positioning member.

* * * * *